US009671096B2

(12) United States Patent
Odom

(10) Patent No.: US 9,671,096 B2
(45) Date of Patent: Jun. 6, 2017

(54) TV REMOTE CONTROL LIGHTING

(71) Applicant: Doug Odom, Conway, AR (US)

(72) Inventor: Doug Odom, Conway, AR (US)

( * ) Notice: Subject to any disclaimer, the term of this patent is extended or adjusted under 35 U.S.C. 154(b) by 0 days.

(21) Appl. No.: 14/814,706

(22) Filed: Jul. 31, 2015

(65) Prior Publication Data

US 2017/0030562 A1 Feb. 2, 2017

(51) Int. Cl.

| | |
|---|---|
| ***F21V 33/00*** | (2006.01) |
| ***F21V 21/088*** | (2006.01) |
| ***F21V 21/32*** | (2006.01) |
| *F21Y 101/02* | (2006.01) |

(52) U.S. Cl.

CPC ..... *F21V 21/088* (2013.01); *F21V 21/32* (2013.01); *F21Y 2101/02* (2013.01)

(58) Field of Classification Search

CPC .... F21V 21/088; F21V 21/32; F21V 21/0885; F21V 33/0052; F21Y 2101/02

See application file for complete search history.

(56) References Cited

U.S. PATENT DOCUMENTS 4,598,340 A * 7/1986 Dwosh ..... F21S 9/02 362/183
4,831,500 A * 5/1989 McNemar ..... G01D 11/28 33/348
4,905,127 A * 2/1990 Kaminski ..... F21V 33/0052 362/109
4,949,230 A * 8/1990 Burmeister ..... F21L 11/00 362/109
5,055,977 A * 10/1991 Acquanetta ..... H01H 9/025 362/109
5,183,325 A * 2/1993 Hurdle ..... F21V 21/0808 362/109
5,188,448 A * 2/1993 Siriani ..... F21V 33/0052 362/109
5,486,986 A * 1/1996 Brada ..... F21V 33/0052 362/109
5,564,814 A * 10/1996 Anderson ..... F21V 33/0052 362/109
5,575,556 A * 11/1996 Kennedy ..... G02B 25/002 362/109
6,050,696 A * 4/2000 Radley ..... F21V 33/0052 362/109
6,799,861 B2 * 10/2004 Naghi ..... F21V 21/32 361/679.23

(Continued)

*Primary Examiner* — Ali Alavi

(57) ABSTRACT

A system for focused lighting on a remote control including: a bracket, where the bracket includes a cradle and a release clip, where the release clip enables the placement of the bracket onto the remote control; a first set of clamps extending from a first side of the cradle, where the first set of clamps extend around a first side of the remote control; a second set of clamps extending from a second side of the cradle, where the second set of clamps extend around a second side of the remote control; a stem extending from the cradle; and a LED light at a distal end of the stem, where the LED light illuminates a control panel of the remote control. Preferably, the cradle and release clip abut an underside of the remote control. Also preferably, the stem extends from the underside of the remote control to the control panel side and the direction of the LED light is adjustable.

4 Claims, 2 Drawing Sheets

(56) References Cited

U.S. PATENT DOCUMENTS

| | | | | |
|---|---|---|---|---|
| 6,932,485 | B2 * | 8/2005 | Hussaini | F21V 21/30<br>362/109 |
| 2002/0163797 | A1 * | 11/2002 | Naghi | A63F 13/02<br>362/84 |
| 2013/0003371 | A1 * | 1/2013 | Restel | F21V 21/088<br>362/249.01 |
| 2013/0215324 | A1 * | 8/2013 | Manning | F41J 3/0004<br>348/373 |

* cited by examiner

TV REMOTE CONTROL LIGHTING

BACKGROUND OF THE INVENTION

Field of Invention

The present invention relates lighting that is attached to a standard remote control.

Description of Related Art

Remote controls are common devices used to control functions related to televisions and other electronic devices such as audio systems or computers. A remote control is usually a hand-held device that includes a series of control buttons on one side of the device. The remote control operates various functions such as on/off, channel changing, volume, component selection and other features that may be part of an entertainment system associated with a television. Some remote controls include a glow-in-the-dark feature that offers soft lighting so that a user may use the remote in the dark. However some of the soft lighting associated with the remotes is ineffective. Therefore a user must turn on a light or place the remote under a light in order to view the control buttons associated with the remote control. As a result, it would be advantageous to have a device that may be attached to a standard remote control that enabled focused lighting over the surface of the remote for use in the dark.

SUMMARY OF THE INVENTION

The present invention relates to a system for focused lighting on a remote control including: a bracket, where the bracket includes a cradle and a release clip, where the release clip enables the placement of the bracket onto the remote control; a first set of clamps extending from a first side of the cradle, where the first set of clamps extend around a first side of the remote control; a second set of clamps extending from a second side of the cradle, where the second set of clamps extend around a second side of the remote control; a stem extending from the cradle; and a LED light at a distal end of the stem, where the LED light illuminates a control panel of the remote control. Preferably, the cradle and release clip abut an underside of the remote control. Also preferably, the stem extends from the underside of the remote control to the control panel side and the direction of the LED light is adjustable.

DETAILED DESCRIPTION

The present invention relates to a light that attaches to a remote control providing focused lighting over the control buttons associated with the remote control. This lighting is attached through the use of a bracket that has clamps extending around the side of the remote control. Further a stem extends from the bracket and includes a LED light at the distal end of the stem. The direction of the lighting is controllable over the top surface of the remote control. The stem is flexible and provides a means to bend and adjust the light as needed over the surface of the remote control. The bracket and clamps are attached to the remote control and therefore the device is suitable for any typical remote control use with electronics.

Figure 1:
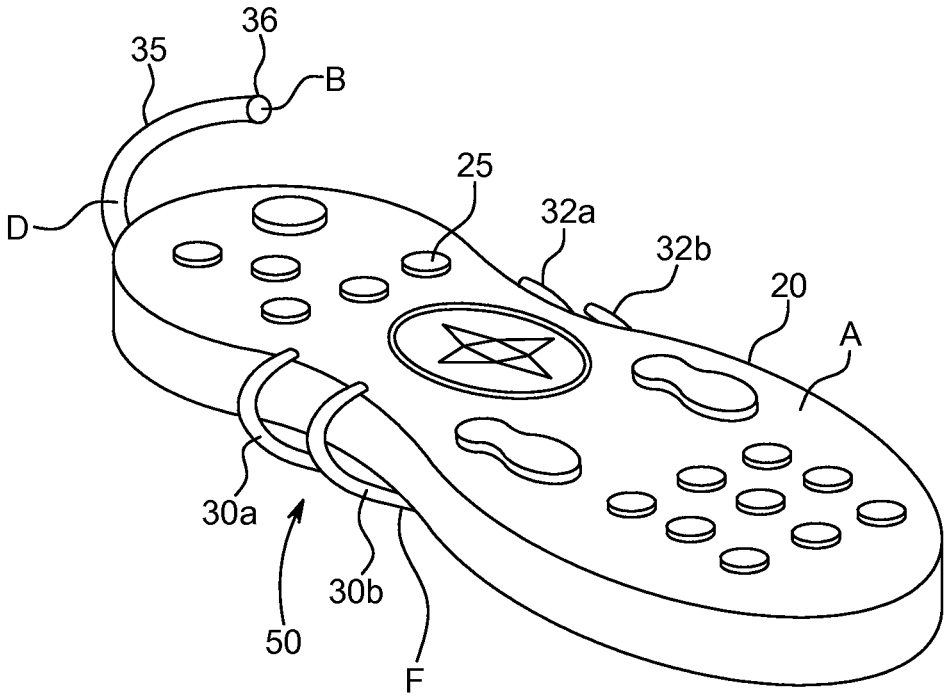
FIG. 1 depicts a remote control with a focused light attached thereto.
Figure 2:
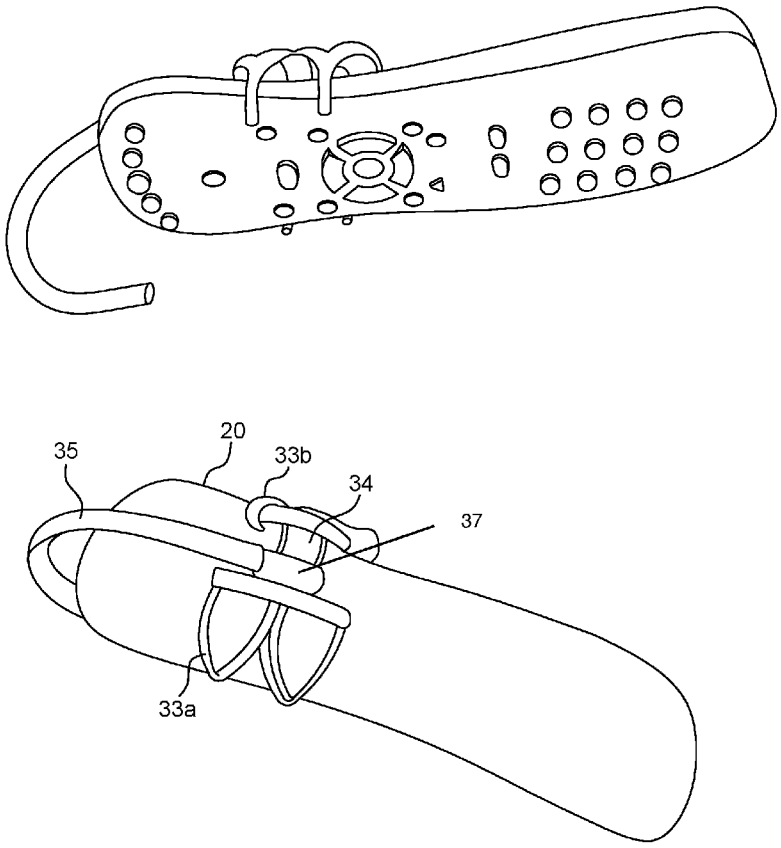
FIG. 2 depicts a remote control showing the underside with the focused light attached thereto.

In reference to FIG. 1, a perspective view of a Remote Control 20 is shown. Attached to the Remote Control 20 is Bracket 50 that includes Clamps 30(*a*), 30(*b*) on a first side of the Remote Control 20. Clamps 32(*a*), 32(*b*) extend around a second side of the Remote Control 20. Control Buttons 25 are shown across the top surface of the Remote Control 20. Extending over the Control Buttons 25 is a Stem 35 that includes LED Light 36. The Stem 35 extends from the Bracket 50 from the underside of the Remote Control 20. Stem 35 is further shown in FIG. 2 where it joins with the Bracket 50. At a proximal end of Stem 35 is a power source Compartment 37. Within the power source Compartment 37 is a battery, not shown, that provides power for the LED Light 36. Preferably, the battery is a lithium battery. Also shown in FIG. 2 is Cradle 33(*a*), 33(*b*) that forms the base of the Bracket 50. A Release Clip 34 is also shown that allows for the release of the Bracket 50 from the Remote Control 20.

During use a user places the Remote Control 20 onto the Bracket 50 and extends the Stem 35 around the underside of the Remote Control 20 directing the Light 36 toward the Control Buttons 25. Once the Light 36 is illuminated the user may easily control the functions associated with Remote Control 20 while operating in the dark. The present invention nullifies the need for the soft lighting associated with many remote controls and provides a highly effective and suitable mechanism to direct focused light over a remote control. The instant invention has been shown and described in what it considers to be the most practical and preferred embodiments. It is recognized, however, that departures may be made there from within the scope of the invention and that obvious modifications will occur to a person skilled in the art.

What is claimed is:

1. A system for focused lighting on a remote control comprising:

a. a bracket, where the bracket includes a cradle and a release clip, where the release clip enables the placement of the bracket onto the remote control;

b. a first set of clamps extending from a first side of the cradle, where the first set of clamps extend around a first side of the remote control;

c. a second set of clamps extending from a second side of the cradle, where the second set of clamps extend around a second side of the remote control;

d. a stem extending from the cradle;

e. a LED light at a distal end of the stem, where the LED light illuminates a control panel of the remote control; and f. a power source compartment at a proximal end of the stem, wherein the power source supplies power to the LED light.

2. The system according to claim 1, where the cradle and release clip abut an underside of the remote control.

3. The system according to claim 2, where the stem extends from the underside of the remote control to the control panel side.

4. The system according to claim 1, where the direction of the LED light is adjustable.

* * * * *